United States Patent [19]

Zimmermann

[11] Patent Number: 5,020,718

[45] Date of Patent: Jun. 4, 1991

[54] SEVERABLE CONNECTION BETWEEN A HANDLE AND A DIVIDER PANEL OF A CARTON

[75] Inventor: John Zimmermann, Scarborough, Canada

[73] Assignee: Paperboard Industries Corporation, Toronto, Canada

[21] Appl. No.: 550,125

[22] Filed: Jul. 9, 1990

[51] Int. Cl.[5] ..... B65D 5/46; B65D 5/48

[52] U.S. Cl. ..... 229/117.22; 206/198

[58] Field of Search ..... 229/117.22, 120.02, 229/120.38; 206/198

[56] References Cited

U.S. PATENT DOCUMENTS

| | | | |
|---|---|---|---|
| 2,609,137 | 9/1952 | Toensmeier | 229/117.22 |
| 3,079,040 | 2/1963 | Vesak | 229/117.22 |
| 3,531,042 | 9/1970 | Atkinson | 229/117.22 |
| 3,807,625 | 4/1974 | Akkerman | 229/117.22 |
| 3,820,710 | 6/1974 | Burgess et al. | 229/117.22 |
| 3,825,171 | 7/1974 | Dewhurst | 229/117.22 |
| 3,860,163 | 1/1975 | Dewhurst | 229/117.22 |
| 3,940,055 | 2/1976 | Rowley | 229/117.22 |
| 4,403,690 | 9/1983 | Fischer | 229/117.22 |

*Primary Examiner*—Gary E. Elkins

*Attorney, Agent, or Firm*—Fetherstonhaugh & Co.

[57] ABSTRACT

A divider panel assembly for a carton which has a handle panel and an anchor panel which are interconnected by tear bars is cut to form the tear bars in a manner which will maintain the strength of the handle panel while facilitating the separation of the handle panel and the anchor panel. The joint between the handle panel and the anchor panel is formed by providing a plurality of cuts at the connection between the handle panel and the anchor panel. Each joint has first, second and third cuts which are arranged to form tear bars therebetween which are of a greater length than the tear bars previously known so as to facilitate the initial movement of the handle with respect to the anchor panel and the ease with which the tear bars may ultimately be torn. All of the cuts which form the joining means extend in or below the severance plane.

1 Claim, 2 Drawing Sheets

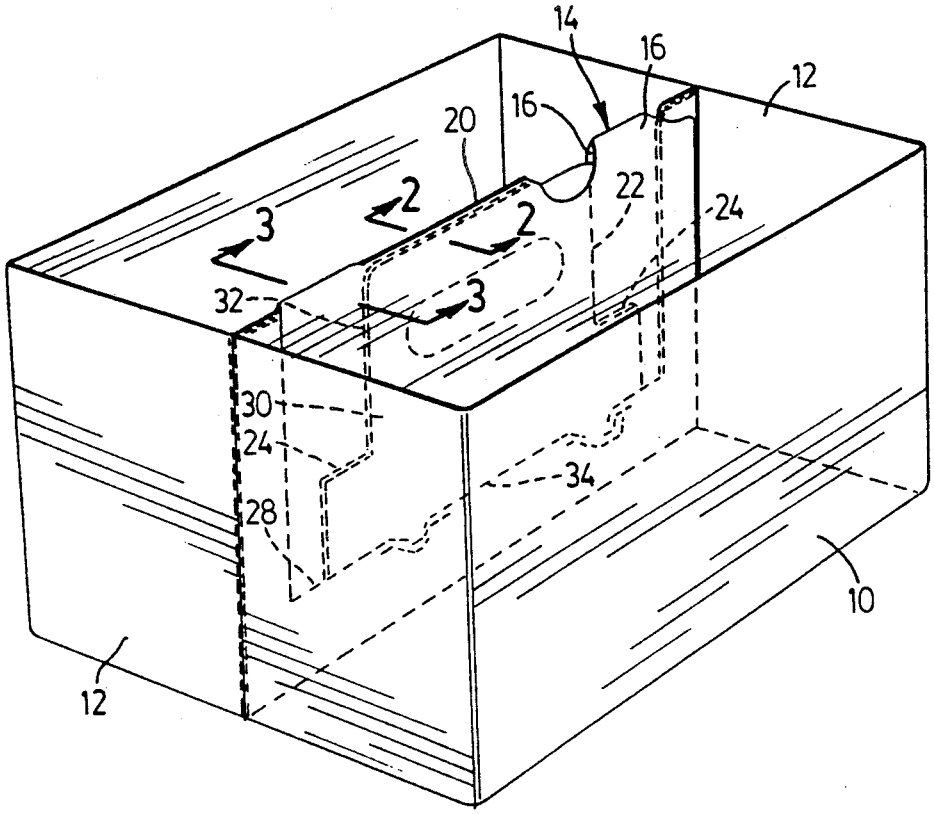
FIG. 1
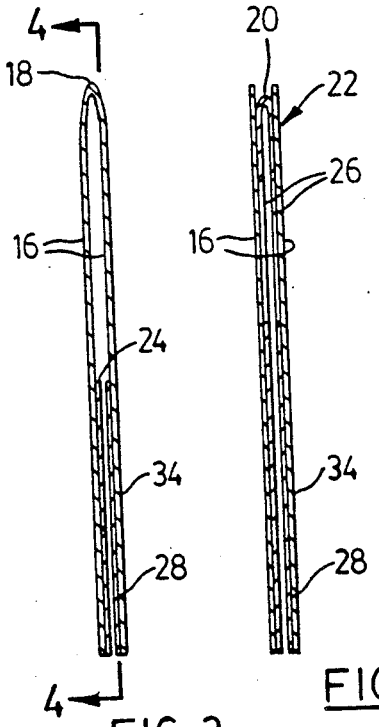
FIG. 3
FIG. 2

SEVERABLE CONNECTION BETWEEN A HANDLE AND A DIVIDER PANEL OF A CARTON

BACKGROUND OF INVENTION

This invention relates to dividers for use in cartons in which a handle is formed integrally with the divider. In particular, this invention relates to a structure in which the handle is detachably secured to the divider during the assembly of the divider and can be separated therefrom so as to be raised to extend above the carton in which the divider is located.

The divider of the type to which the present invention is directed is described in Canadian Patent No. 946,335. In this divider construction, the handle is initially connected to the anchor panel by so-called bars which are formed by cutting the divider panel in a manner which will serve to cause the bars to tear when the handle panel is lifted upwardly away from the anchor panel.

It has been found in practice that the preferred bar structure is a modified version of that illustrated in FIG. 5 of Patent 946,335 in which two bars are provided. The modification involves extending the uppermost and lowermost cut lines so that they extend downwardly and upwardly respectively in a spaced parallel relationship with respect to the angularly inclined portion of the Z-shaped central cut line.

It has been found that it is advantageous to provide two bars rather than the single bar which is illustrated in FIG. 7 of Patent 946,335 because the provision of two bars increases the strength of the initial connection between the handle panel and the anchor panel which is important during the initial forming and folding of the divider panel.

The handle described in Patent 946,335 is formed with a shoulder which bears against the folded upper edge of the anchor panel to support the weight of the carton and its contents when the carton is being carried by the handle. The strength of this shoulder is dependent upon the height of the shoulder panel. As is shown in FIG. 4 of Patent 946,335, the cut lines used to form the double bar connect includes cuts that extend above the horizontal severance plane along which the handle is severed from the anchor panel in use. As a result, the weakest point of the handle is along the line that extends from the intersection of the upper edge of the shoulder and the vertical side edge of the handle portion and the uppermost cut- line of the adjacent connecting bars.

It will also be noted that the pattern of the cut lines of Patent 946,335 is such that the cut lines of each set of connecting bars are identical to one another. That is to say, the cut lines are each of the same "hand". As a result of this structure, when the handle panel is initially raised, the panel will tend to move laterally. This results in a twisting or bending of the connecting arms and can make the initial tearing operation somewhat more difficult.

It will be noted that the free length of the interconnecting arms formed by the cut pattern of Patent 946,335 is relatively short. As a result, very little vertical movement of the handle is permitted before it is necessary to tear the bars to free the handle. Generally the most difficult operation involved in manipulating the handle panel to its raised position is the effort required to tear the connecting bars to release the handle from the anchor panel. This is made more difficult because it is necessary to apply the forces necessary to tear the handle before the handle is raised to a sufficient extent to provide good finger access to the opening in the handle.

SUMMARY OF INVENTION

It is an object of the present invention to provide an improved connecting structure for connecting a handle to an anchor panel of a carton divider.

It is a further object of the present invention to provide connecting bars which interconnect the handle and the anchor panel which are elongated so as to permit the handle to be raised a substantial distance from the anchor panel before the connecting bars need to be torn to release the handle.

It is a further object of the present invention to provide a pattern of cuts which form the connecting bars in which right and left hand patterns are used to ensure that the handle may be raised vertically during the initial separation of the handle and anchor panel.

It is a still further object of the present invention to provide a structure in which two connecting bars are provided at each connecting point and wherein both connecting bars extend below the plane of severance along which the remainder of the handle panel is severed from the anchor panel.

According to one aspect of the present invention, there is provided in a divider panel assembly of the type which has a handle panel that is formed integrally with an anchor panel, the handle panel having shoulders that project laterally from opposite side edges of the handle portion thereof which serve to support the weight of a carton that is carried by the handle in use, the handle panel being severed from the anchor panel along a severance cut that extends in a severance plane that extends transversely below the handle panel and is interrupted by first and second tearable joining means that connect the handle panel and the anchor panel, the first and second joining means being located one below each side edge of the handle portion, the improvement wherein each joining means comprises; a first cut which has a first portion of its length that extends along the severance plane and a second portion of its length that extends downwardly and inwardly from the first portion to a terminal end portion, a second cut which has first and second portions of its length located below and extending parallel to the first and second portions of the first cut and a third portion that extends upwardly from the second portion in a plane that is parallel to the severance plane to form a first tear bar therebetween, a third cut that extends from a first end and has first and second portions of its length that are located below and extend parallel to the second and third portions of the second cut and a third portion that extends upwardly and inwardly to the severance plane, the second and third cuts being separated from one another by a second tear bar, the terminal end of the first cut and the first end of the third cut being disposed opposite one another on opposite sides of the second cut.

BRIEF DESCRIPTION OF THE DRAWINGS

FIG. 1 is a perspective view of a container in which a divider panel assembly that is constructed in accordance with an embodiment of the present invention is located.

FIG. 2 is a sectional view of the divider taken along the line 2—2 of FIG. 1.

FIG. 3 is a sectional view of the divider taken along the line 3—3 of FIG. 1.

With reference to FIG. 1 of the drawings, the reference numeral 10 refers generally to a carton which, with the exception of the joining means that is used to connect the handle panel to the anchor panel, is constructed generally in accordance with U.S. Pat. No. 2,609,137.

Figure 4:
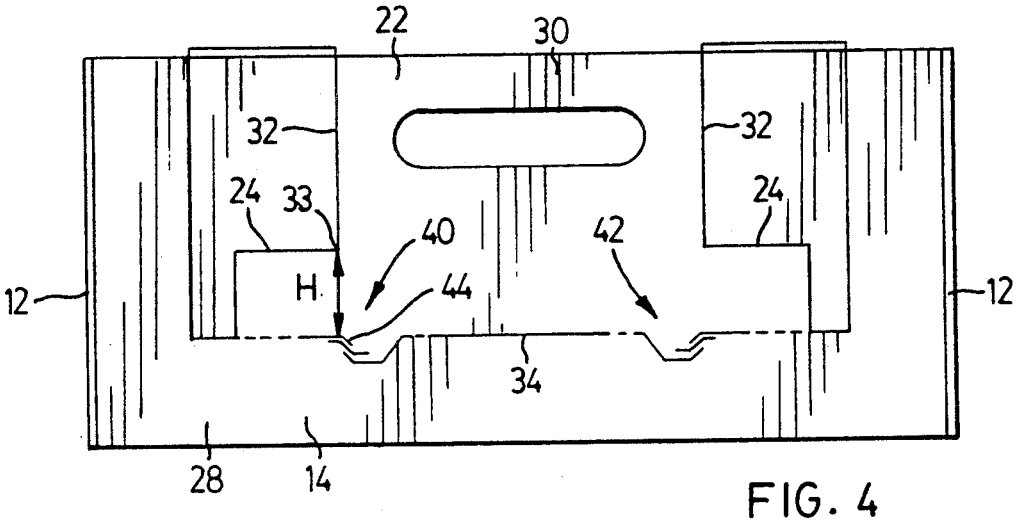
FIG. 4 is a sectional view taken along the line 4—4 of FIG. 3.

The carton 10 has end walls 12 and a divider wall generally identified by the reference numeral 14 which extends along the length of the container between the end walls 12.

With the exception of the joining means the divider 14 is formed from a series of hingedly connected panels in the manner described in U.S. Pat. No. 2,609,137. The divider has a pair of outer panels 16 joined at their upper ends by a fold line 18 which has a central section removed to provide an opening 20 through which the gripping portion of the handle member 22 may pass. The handle member 22 is severably connected to an anchor panel 28 along the generally horizontally extending severance line 34. The divider also has a pair of shoulders 24 that project laterally outwardly from opposite side edges 32 of the handle portion 30.

Figure 5:
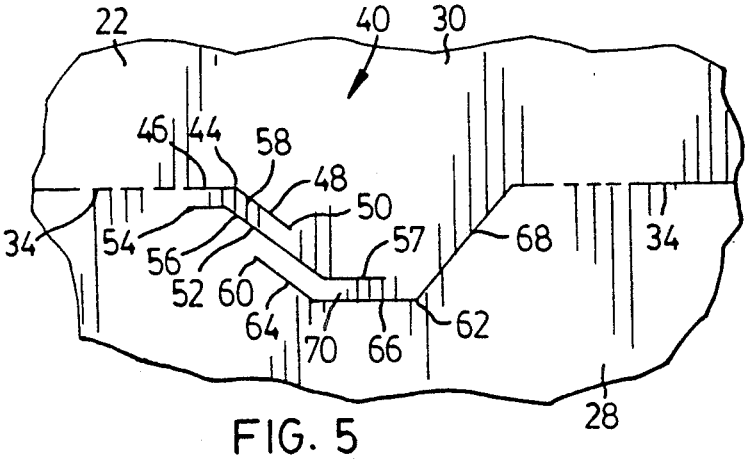
FIG. 5 is an enlarged detail showing the pattern of the cuts and severance bars illustrated in FIG. 4.

The present invention can be distinguished from the structure disclosed in Canadian Patent No. 946,335 because of the shape configuration and orientation of the joining means used to connect the handle member 22 to the anchor panel 28. The joining means is generally identified by reference numerals 40 and 42 in FIG. 4 of the drawings. The joining means 40 is of an opposite hand to the joining means 42. Otherwise the joining means 40 and the joining means 42 are identical to one another. As shown in FIG. 5 of the drawings, the joining means 40 includes a first cut 44 which has a first portion of its length 46 that extends along the severance plane 34 and a second portion of its length 48 that extends downwardly and inwardly from the first portion and terminates at 50. A second cut 52 has a first portion 54 and a second portion 56 of its length located below and extending parallel to the first portion 46 and second portion 48 of the first cut 44. A third portion 57 extends inwardly from the lower end of the second portion 56 parallel to the severance plane 34 to form a first tear bar 58.

A third cut 62 extends from a first end 60 and has first and second portions 64 and 66 that are located below and extend parallel to the second and third portions 56 and 58. The third cut also includes a third portion 68 which extends upwardly and inwardly to the severance plane 34. The second cut 52 is separated from the third cut 64 by a second tear bar 70. The terminal end 50 of the first cut and the first end 60 of the third cut are disposed opposite one another on opposite sides of the second portion 56 of the second cut and are located substantially centrally of the length of the second portion 56.

Figure 6:
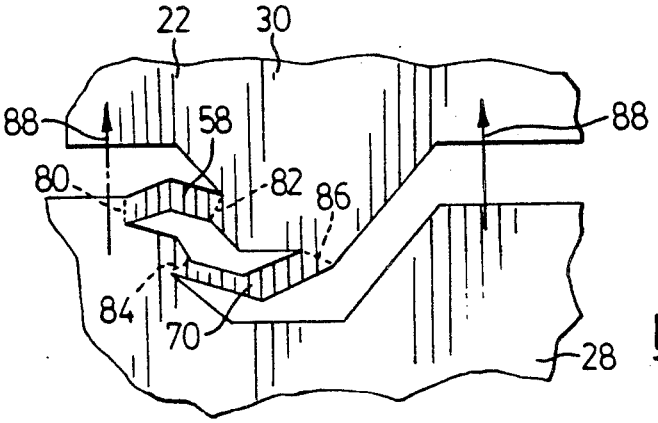
FIG. 6 is a view similar to FIG. 5 showing the position of the severance bars when the handle is raised.

As shown in FIG. 6 of the drawings, when the handle portion 30 is raised with respect to the anchor panel 28, the first and second tear bars 58 and 70 will be deformed and will assume a configuration at least approximating that illustrated in FIG. 6. Ultimately the continued raising of the handle portion will cause the tear bars to sever along one or other of the tear lines 80, 82 and one or other of the tear lines 84, 86.

Because of the fact that the joining means 40 and 42 are of opposite hand configuration, the raising of the handle portion 30 will tend to occur in the general direction of the vertically oriented arrows 88.

Because the tear bars 58 and 70 are considerably longer than the tear bars of prior Canadian Patent No. 946,335, they are more flexible than the previously known tear bars; and as a result it is possible to initiate the lifting of the handle portion more easily. Typically the length of each section of the tear bar of the present invention is about 5 mm. with the result that the total length of each chair bar is about 1 cm. This contrasts with the previously known tear bars which have a total length of about 5 mm.

It will also be noted that because none of the tear lines extend above the severance plane 34, the distance H from the corner 33 which is formed between the shoulder 24 and the side edge 32 to the first cut line 44 is at least equal to the distance from the corner 33 to the severance plane 34 with the result that the forming of the joining means does not weaken the handle structure along its weakest point which is the vertical plane that extends from the corner 33.

From the foregoing, it will be apparent that the present invention provides an improved joining means for releasably securing the handle of a divider panel to its anchor panel. The joining means serves to permit the handle to be displaced from its initial storage position to a partially raised position with ease without weakening the connection formed between the shoulder portions of the handle and the hand engaging portion. These and other advantages of the structure of the present invention will be apparent to those skilled in the art.

I claim:

1. In a divider panel assembly of the type which has a handle panel that is formed integrally with a anchor panel, the handle panel having shoulders that project laterally from opposite side edges of the handle portion thereof which serve to support the weight of a carton that is carried by the handle in use, the handle panel being severed from the anchor panel along a severance cut that extends in a severance plane that extends transversely below the handle panel and is interrupted by first and second tearable joining means that connect the handle panel and the anchor panel, the first and second joining means being located one below each side edge of the handle portion, the improvement wherein each joining means comprises;

a) a first cut which has a first portion of its length that extends along the severance plane and a second portion of its length that extends downwardly and inwardly from the first portion to a terminal end, b) a second cut which has first and second portions of its length located below and extending parallel to the first and second portions of the first cut and a third portion that extends inwardly from the second portion of the second cut in a plane that is parallel to the severance plane to form a first tear bar between the first and second cuts, c) a third cut that extends from a first end and has first and second portions of its length that are located below and extend parallel to the second and third portions of the second cut and a third portion that extends upwardly and inwardly to the severance plane, the second and third cuts being separated from one another by a second tear bar, d) the terminal end of the first cut and the first end of the third cut being disposed opposite one another on opposite sides of the second cut.

* * * * *